US007912413B2

(12) United States Patent
Murakami

(10) Patent No.: US 7,912,413 B2
(45) Date of Patent: Mar. 22, 2011

(54) FIXING DEVICE HAVING GOOD WARM-UP PROPERTY AND IMAGE FORMATION APPARATUS

(75) Inventor: Masanori Murakami, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 98 days.

(21) Appl. No.: 12/483,769

(22) Filed: Jun. 12, 2009

(65) Prior Publication Data

US 2009/0317157 A1 Dec. 24, 2009

(30) Foreign Application Priority Data

Jun. 19, 2008 (JP) ..... 2008-160576

(51) Int. Cl.
*G03G 15/20* (2006.01)

(52) U.S. Cl. ..... 399/329; 219/619; 399/333

(58) Field of Classification Search ..... 219/619; 399/329, 330, 331, 333
See application file for complete search history.

(56) References Cited

U.S. PATENT DOCUMENTS

| | | | | |
|---|---|---|---|---|
| 6,021,303 | A | 2/2000 | Terada et al. | |
| 7,415,235 | B2 * | 8/2008 | Aze et al. | 399/329 |
| 7,462,804 | B2 | 12/2008 | Shirakata et al. | |
| 7,483,666 | B2 | 1/2009 | Tatematsu et al. | |
| 7,647,017 | B2 * | 1/2010 | Uehara et al. | 399/333 |
| 2007/0242988 | A1 | 10/2007 | Seo et al. | |
| 2008/0124147 | A1 | 5/2008 | Uehara et al. | |
| 2009/0028617 | A1 | 1/2009 | Katakabe et al. | |

FOREIGN PATENT DOCUMENTS

| | | |
|---|---|---|
| JP | 2005-208596 | 8/2005 |
| JP | 2007-079131 | 3/2007 |
| JP | 2007-156065 A | 6/2007 |
| JP | 2007-264421 | 10/2007 |
| JP | 2007-264421 A | 10/2007 |
| JP | 3988251 | 10/2007 |
| JP | 3988251 B2 | 10/2007 |
| JP | 2007-310353 | 11/2007 |
| JP | 2008-129517 | 6/2008 |
| WO | WO 2006/098275 | 9/2006 |

OTHER PUBLICATIONS

Notification of Reasons for Refusal issued in the corresponding Japanese Patent Application No. 2008-160576 dated Jun. 15, 2010, and an English Translation thereof.

* cited by examiner

*Primary Examiner* — Hoang Ngo
(74) *Attorney, Agent, or Firm* — Buchanan Ingersoll & Rooney PC

(57) ABSTRACT

Disclosed is a fixing device having a self-temperature control function, and reducing a heat capacity of a heat generation member for saving energy and achieving good warm-up property. The fixing device includes a fixed plate inside a closed rotation path of a belt, contacting an inner circumferential surface of the belt, substantially opposed to an excitation coil with the belt therebetween, keeping the belt on the rotation path. The fixed plate includes: a magnetic shunt alloy layer made of a magnetic shunt alloy; a conductive heat generation layer being disposed toward a main surface of the magnetic shunt alloy layer facing the belt, being made of a conductor other than the alloy, and being thinner than the alloy layer; and a low resistance conductive layer being disposed toward another main surface, having a lower electric resistance value than the heat generation layer, and being thicker than the heat generation layer.

10 Claims, 7 Drawing Sheets

56

FIXING DEVICE HAVING GOOD WARM-UP PROPERTY AND IMAGE FORMATION APPARATUS

This application is based on application No. 2008-160576 filed in Japan, the contents of which are hereby incorporated by reference.

BACKGROUND OF THE INVENTION (1) Field of the Invention

The present invention relates to an image formation apparatus including a fixing device, and in particular to technology for, when an image is thermally fixed on a smaller-sized recording sheet among several-sized recording sheets by using an induction heating method, suppressing a temperature increase in an area corresponding to a portion that is out of contact with the sheet when the sheet passes through a fixing nip thereof.

(2) Description of the Related Art

In recent years, some fixing devices included in electrophotographic type image formation apparatuses or electrostatic recording type image formation apparatuses are starting to utilize heat sources of an induction heating type that are compact and have relatively high heat conversion efficiency. Such fixing devices are gaining popularity for conserving energy, saving space, reducing a warm-up period, and so on.

In particular, it is possible to manufacture a heat generation member with a significantly small heat capacity by configuring a fixing device to direct magnetic flux, which is generated by supplying an alternating electric current to excitation coil, to a conductive heat generation layer provided at a heat generation member being out of contact with core components, with use of the core components such as ferrite cores, such that the heat generation member is locally heated. This can reduce the warm-up period to a great extent.

However, with the heat generation member having a small heat capacity, the heat cannot be easily transmitted. Here, if small-sized recording sheets having a small width are continuously used, the temperature of portions of the heat generation member that do not come into contact with the recording sheets (hereinafter, "contactless portions") will be abnormally increased, the contactless portions being outer edges of the heat generation member in the width direction thereof. This may thermally damage or deteriorate the components positioned in the vicinity of the contactless portions. Also, if a recording sheet having a large width is used immediately after the small-sized recording sheets, then the hot offset will occur only in the outer edges of the printed sheet in the width direction thereof, and the printed recording sheet will have uneven glossiness.

There are several techniques that are known to suppress the temperature increase in the contactless portions in the above-described fixing device, e.g., a technique to shield only a part of the magnetic flux that is proceeding toward the contactless portions by moving a conductor component in accordance with the sheet width, and a technique to cancel out only a part of the magnetic flux that is proceeding toward the contactless portions by using degaussing coils.

The following documents disclose techniques to suppress an excessive increase in the temperature of the contactless portions by providing the heat generation member for the above-described fixing device with a magnetic shunt alloy whose Curie point is somewhat higher than the fixing temperature. Due to the presence of such a magnetic shunt alloy, when the temperature of the contactless portions has been increased to some extent, the heat generation member has the self-temperature control function of automatically losing magnetism in the contactless portions, and reducing the heat capacity.

Patent Document 1 (Japanese Patent Publication No. 3988251) discloses, for example, an image heating device that causes a heat generation layer including a magnetic shunt alloy layer to come into contact with the back of a fixing belt. According to Patent Document 1, the fixing belt has a very small heat capacity, rendering a warm-up period extremely short. Furthermore, it is disclosed in Patent Document 1 that, as the self-temperature control is effectively performed, excitation components would not get thermally damaged even when printing on a succession of recording sheets each having a small width.

Patent Document 2 (Japanese Laid-Open Patent Application No. 2007-156065) discloses a fixing device having a shield plate provided inside a cylindrical heat generation roller made of a magnetic shunt alloy and extending in an axial direction of the heat generation roller. The shield plate has a cross section substantially in a C shape taken perpendicularly to the axial direction such that an edge of each end portion of the shield plate is opposed to the heat generation roller. According to Patent Document 2, the thermal load in relation to the heat generation roller is small. This, Patent Document 2 discloses, suppresses an excessive temperature increase, reduces a warm-up period, and prevents occurrence of an offset, thus providing a high-quality fixing performance.

Patent Document 3 (Japanese Laid-Open Patent Application No. 2007-264421) discloses the following fixer. The fixer includes a low-resistance, plate-like member extending in the axial direction thereof and provided inside a cylindrical fixing rotary body. The low-resistance, plate-like member has a central portion facing a central portion of the fixing rotary body. The central portion of the low-resistance, plate-like member is thinner than each end portion of the shield plate, wherein each end portion has a larger thickness than the thickness by which magnetic flux penetrates thereinto. According to Patent Document 3, the self-temperature control function works effectively especially on both end portions of the fixing rotary body in the width direction thereof, and suppresses an excessive temperature increase in said end portions without lowering the warm-up performance and heating efficiency of the central portion of the fixing rotary body. Patent Document 3 discloses that, even when printing on a succession of small-sized recording sheets, it is possible to reliably suppresses the excessive temperature increase in said end portions without the central portion of the fixing rotary body being insufficiently heated.

Meanwhile, during a stand-by period in which the image formation is not performed, the temperature of the fixer needs to be maintained at a stand-by temperature from which the fixer can reach the fixing temperature in a few seconds, so as to promptly start the fixing whenever an instruction to perform the image formation is issued. Especially, if the fixer has a poor warm-up property, the stand-by temperature must be set high. This is not suitable for saving energy. Furthermore, if the fixer has a poor warm-up property, the user has to wait for quite a while upon turning on the power of the image formation apparatus, which is not favorable.

In order for the fixing device to save energy and have a good warm-up property, it is effective to downsize the structure thereof and thereby reducing the heat capacity thereof. Accordingly, the fixing device is desired to be more compact.

SUMMARY OF THE INVENTION

The present invention is conceived in view of the foregoing problems. An object of the present invention is to provide a fixing device that can control a temperature thereof with the use of a magnetic shunt alloy and making a heat capacity of the heat generation member smaller than that of the prior art so that the fixing device can save energy and have good warm-up property, and an image formation apparatus having the same fixing device.

The above object is achieved by a fixing device that thermally fixes an unfixed image onto a recording sheet having the unfixed image formed thereon, by passing the recording sheet through a fixing nip, the fixing device including: an endless belt being rotated in a closed rotation path and being heated by electromagnetic induction; a first roller being positioned inside the closed rotation path; a second roller pressing the first roller from outside of the closed rotation path such that the fixing nip is formed between an outer circumferential surface of the belt and the second roller; an excitation coil being positioned outside the closed rotation path; and a fixed plate being positioned inside the closed rotation path, being in contact with an inner circumferential surface of the belt, and being substantially opposed to the excitation coil with the belt therebetween, the fixed plate keeping the belt on the closed rotation path, wherein the fixed plate includes: a magnetic shunt alloy layer made of a magnetic shunt alloy; a conductive heat generation layer being disposed toward a main surface of the magnetic shunt alloy layer facing the belt, being made of a conductor other than the magnetic shunt alloy, and being thinner than the magnetic shunt alloy layer; and a low resistance conductive layer being disposed toward another main surface of the magnetic shunt alloy layer, having a lower electric resistance value than the conductive heat generation layer, and being thicker than the conductive heat generation layer.

In addition, in order to achieve the above object, the image formation apparatus in accordance with the present invention may have the above fixing device.

Thus, since the conductive heat generation layer, the magnetic shunt alloy layer, and the low resistance conductive layer are integrally layered, the components present inside of the closed rotation path of the fixing belt can be downsized and accordingly the fixing belt can be shortened. Thus, the present invention can control its own temperature with the use of the magnetic shunt alloy, and in addition, can have the lower heat capacity of the fixing belt than the prior art, thereby saving energy and having the good warm-up property.

Heat is generated in the magnetic shunt alloy layer as well. However, if the conductive heat generation layer as in the present invention is absent and if the magnetic shunt alloy layer is made to generate heat, instead, for example, note that it is difficult for the magnetic shut alloy layer to generate an amount of heat necessary for the fixing device. As a result, the warm-up property is poor so that the warm-up period cannot be reduced. In addition, increasing the power output of the excitation coil contradicts the energy saving. According to the present invention, since the conductive heat generation layer is provided above the magnetic shut alloy layer, heat generation efficiency is improved so that energy can be saved and the good warm-up property can be obtained.

In addition, with regard to the fixed plate included in the fixing device and the image formation apparatus, a thickness of the magnetic shunt alloy layer may range between 100 μm and 300 μm, inclusive, a thickness of the conductive heat generation layer may range between 10 μm and 30 μm, inclusive, and a thickness of the low resistance conductive layer may range between 100 μm and 300 μm, inclusive.

Thus, each thickness of the conductive heat generation layer, the magnetic shunt alloy layer, and the low resistance conductive layer falls within the appropriate range so that expected performance can be satisfactorily given.

Herein, with regard to the fixing device and the image formation apparatus, in an area of the fixed plate corresponding to a contactless portion with which a recording sheet of a serviceable smallest width is out of contact when the sheet passes through the fixing nip, the conductive heat generation layer, the magnetic shunt alloy layer, and the low resistance conductive layer may be layered, and in another area of the fixed plate corresponding to a contacting portion with which the recording sheet of the serviceable smallest width is in contact when the sheet passes through the fixing nip, the magnetic shunt alloy layer and the low resistance conductive layer may be layered, the conductive heat generation layer being excluded.

Thus, since the conductive layer is absent in the area corresponding to a portion of the fixed plate with which a recording sheet of all serviceable sizes is in contact, the heat capacity of the heat generation member can be reduced. Accordingly, more energy can be saved and a good warm-up property can be obtained.

Herein, in the fixing device and the image formation apparatus, the magnetic shunt alloy layer composing the fixed plate may be made of a Ni—Fe alloy or a Ni—Fe—Cr alloy, and the Curie point of the magnetic shunt alloy layer may range between 180° C. and 240° C., inclusive.

Thus, since the Curie point of the magnetic shunt alloy layer ranges between 180° C. and 240° C., inclusive, the following problems do not occur. The temperature does not abnormally increase in the contactless portions, or the neighboring components are not thermally destructed or deteriorated. When a recording sheet having a wide width passes subsequent to a recording sheet having a small width, the hot offset does not occur in each edge of the fixed plate in the width direction, or the recording sheet having a wide width does not have uneven glossiness.

In addition, in the fixing device and the image formation apparatus, the fixed plate may further include a low friction layer being disposed closest to the belt, the low friction layer having a lower sliding friction coefficient than the conductive heat generation layer during the rotation, and during the rotation of the belt, the inner circumferential surface of the belt slides with low friction on the low friction layer.

In addition, in the fixing device and the image formation apparatus, the belt may include a low friction layer being disposed on the inner circumferential surface of the belt, the low friction layer having a lower sliding friction coefficient than the belt during the rotation, and during the rotation, the fixed plate slides with low friction on the low friction layer.

In addition, in the fixing device and the image formation apparatus, the fixed plate may include a first low friction layer being disposed closest to the belt, the first low friction layer having a lower sliding friction coefficient than the conductive heat generation layer during the rotation, the belt may include a second low friction layer being disposed on the inner circumferential surface of the belt, the second low friction layer having a lower sliding friction coefficient than the belt during the rotation, and during the rotation, the first low friction layer slides with low friction on the second low friction layer.

In addition, in the fixing device and the image formation apparatus, the low friction layer may be made of a fluororesin.

Thus, since the friction caused by the slide between the fixed belt and the fixed plate is reduced, driving torque of the fixing belt is reduced. Consequently, energy can be saved and the durability thereof can be improved.

In addition, in the fixing device and the image formation apparatus, in a cross-sectional plane perpendicular to a rotation axis of the first roller, the belt has a substantially elliptical shape, and a major axis and a minor axis of the elliptical shape may satisfy the following relationship: the major axis≦the minor axis×2.

Thus, according to the present invention, the belt is much shorter than each disclosure of Patent Document 1 or 2 having two rollers inside the inner circumference of the belt. Consequently, according to the present invention, the heat capacity of the heat generation member is small, which is very advantageous in terms of energy and space saving, reduction of warm-up period and the like.

BRIEF DESCRIPTION OF THE DRAWINGS

These and the other objects, advantages and features of the Invention will become apparent from the following description thereof taken in conjunction with the accompanying drawings which illustrate a specific embodiment of the Invention.

In the drawings.

DESCRIPTION OF THE PREFERRED EMBODIMENT

Embodiment 1

Embodiment 1 relates to an image formation apparatus having a fixing device that thermally fixes an unfixed image onto a recording sheet with the use of a heat source of an induction heating type. The image formation apparatus includes a fixed plate having a layer structure of a conductive heat generation layer, a magnetic shunt alloy layer and a low resistance conductivity layer that are integrally layered, positioned inside an inner circumference of the fixing belt, and opposed to an excitation coil. According to this embodiment, by appropriately setting a thickness of each layer, the fixing device has the self-temperature control function and reduces a heat capacity of a heat generation member such that the energy can be saved and the good warm-up property can be obtained.

<Structure>

Figure 1:
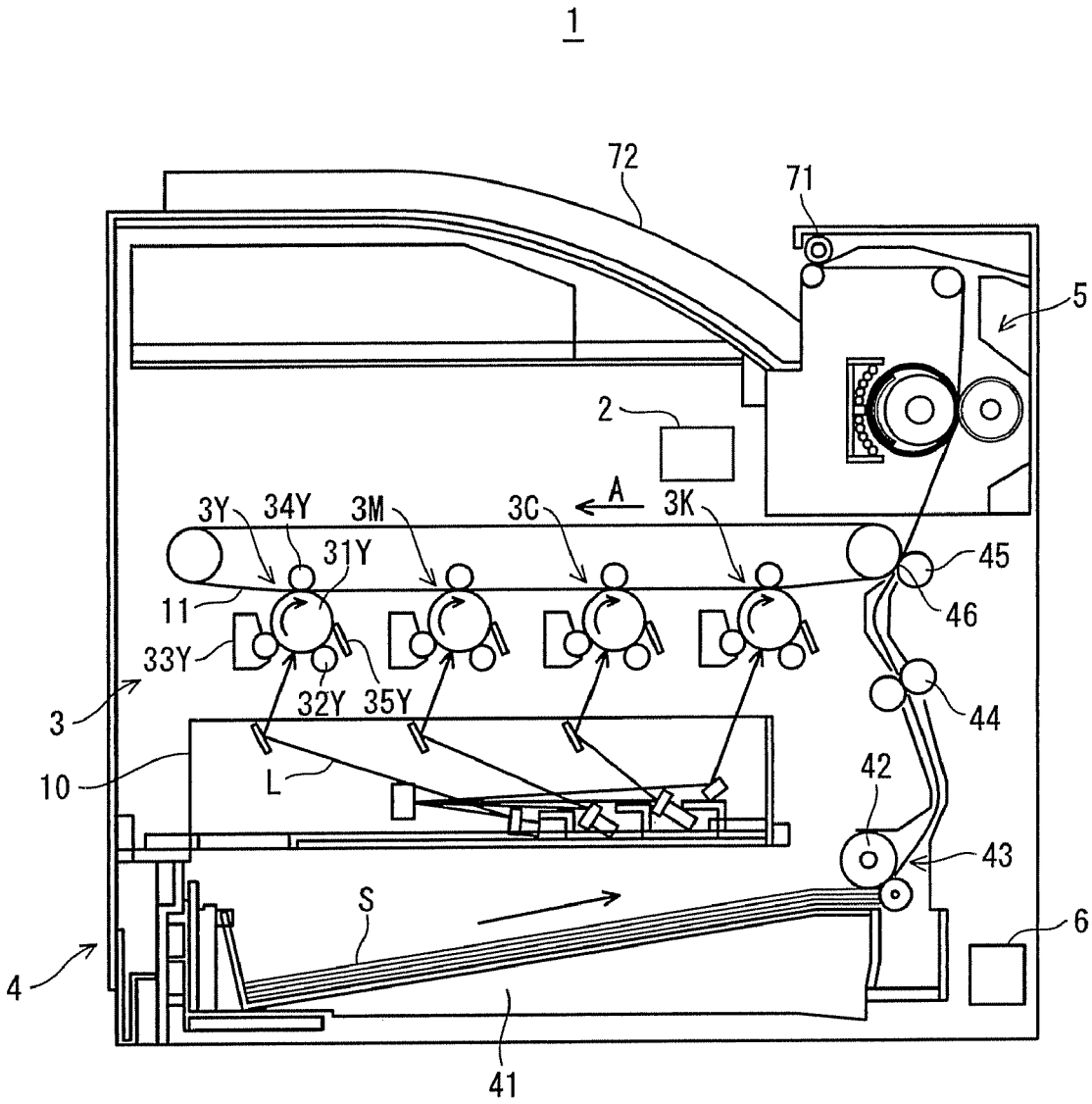
FIG. 1 is an overall view of a structure of an image formation apparatus according to an embodiment of the present invention.

FIG. 1 shows an overall structure of an image formation apparatus according to this embodiment of the present invention.

As shown in FIG. 1, an image formation apparatus 1 of the present embodiment is a tandem digital color printer composed of an alternating current generator 2, an image processor 3, a feeder 4, a fixing device 5, and a controller 6. The image formation apparatus 1 is connected to a network (e.g. office LAN). Upon receiving an instruction to execute a print job from a terminal device in the office, the image formation apparatus 1 forms a color image on a recording sheet and produces an output.

The alternating current generator 2 supplies an alternating current of approximately 40 kHz to an excitation coil provided in the fixing device 5.

The image processor 3 is mainly in charge of image formation. In the image processor 3, image formers 3Y, 3M, 3C and 3K are arranged in a row in the listed order along an intermediate transfer belt 11. The image formers 3Y, 3M, 3C and 3K form toner images of colors yellow, magenta, cyan and black, respectively. Positioned below the image formers 3Y to 3K is an optical unit 10 that includes light emitting devices such as laser diodes. Note that in the image processor 3, the image former 3Y, whose major components have reference numbers each followed by the letter Y, forms an image using yellow toner. Similarly, the image former 3M, whose major components have reference numbers each followed by the letter M, forms an image using magenta toner. The image former 3C, whose major components have reference numbers each followed by the letter C, forms an image using cyan toner. The image former 3K, whose major components have reference numbers each followed by the letter K, forms an image using black toner.

The image formation unit 3Y includes a photosensitive drum 31Y, a charger 32Y, a developer 33Y, a primary transfer roller 34Y, and a cleaner 35Y that are all positioned surrounding the photosensitive drum 31Y.

In order to form an image using yellow toner, the charger 32Y uniformly charges the photosensitive drum 31Y. Then, under the control of the controller 6, the optical unit 10 emits laser light L and applies the laser light L to the uniformly charged photosensitive drum 31Y, which forms an electrostatic latent image. The developer 33Y develops the formed electrostatic latent image using the yellow toner. The developed toner image is primary-transferred to the intermediate transfer belt 11. After this primary-transfer, residual toner attached to the photosensitive drum 31Y is removed by the cleaner 35Y.

The image formers 3M, 3C and 3K are each configured the same as the image formation unit 3Y (the reference numbers of components in the image formers 3M, 3C and 3K are omitted in FIG. 1). Like the image formation unit 3Y, the image formers 3M, 3C and 3K each form an image using toner of the corresponding color.

The toner images of different colors are primary-transferred to the same position on the intermediate transfer belt 11. To be more specific, when said position passes each image formation unit, the toner image of the corresponding color is formed on the intermediate transfer belt 11 such that they are layered on top of one another. These toner images of different colors altogether represent a full-color toner image, so to speak.

Meanwhile, the feeder 4 is mainly in charge of conveying a recording sheet. The feeder 4 includes: a paper feed cassette 41 that contains a recording sheet S; a feeding roller 42 that picks up the sheet S from the paper feed cassette 21 and directs the sheet S onto a conveyance path 43, one sheet at a time; a pair of timing rollers 44 for adjusting a timing to convey the picked sheet S; and a secondary transfer roller 45. Once the recording sheet S has been conveyed to a secondary transfer position 46, the full-color toner image formed on the intermediate transfer belt 11 is secondary-transferred to the recording sheet S at the secondary transfer position 46.

The fixing device 5 is a belt-type fixing device. The fixing device 5 fixes the full-color toner image onto the recording sheet S by applying heat and pressure to the recording sheet S to which the full-color toner image has been secondary-transferred. Specifics of the fixing device 5 are described as follows.

After the fixing, a pair of discharge rollers 71 and the like drives the recording sheet S to be discharged to a discharge tray 72.

The controller 6 collectively controls the overall operation of the image formation apparatus 1, temperature adjustment, and the like. For each of the image formers, the controller 6 generates a drive signal for the corresponding light emitting device in the optical unit 10 based on data of the image to be formed. The controller 6 also adjusts timings of accurately layering the toner images of different colors during the primary transfer, and accurately transferring the full-color toner image to the recording sheet S during the secondary transfer.

Figure 2:
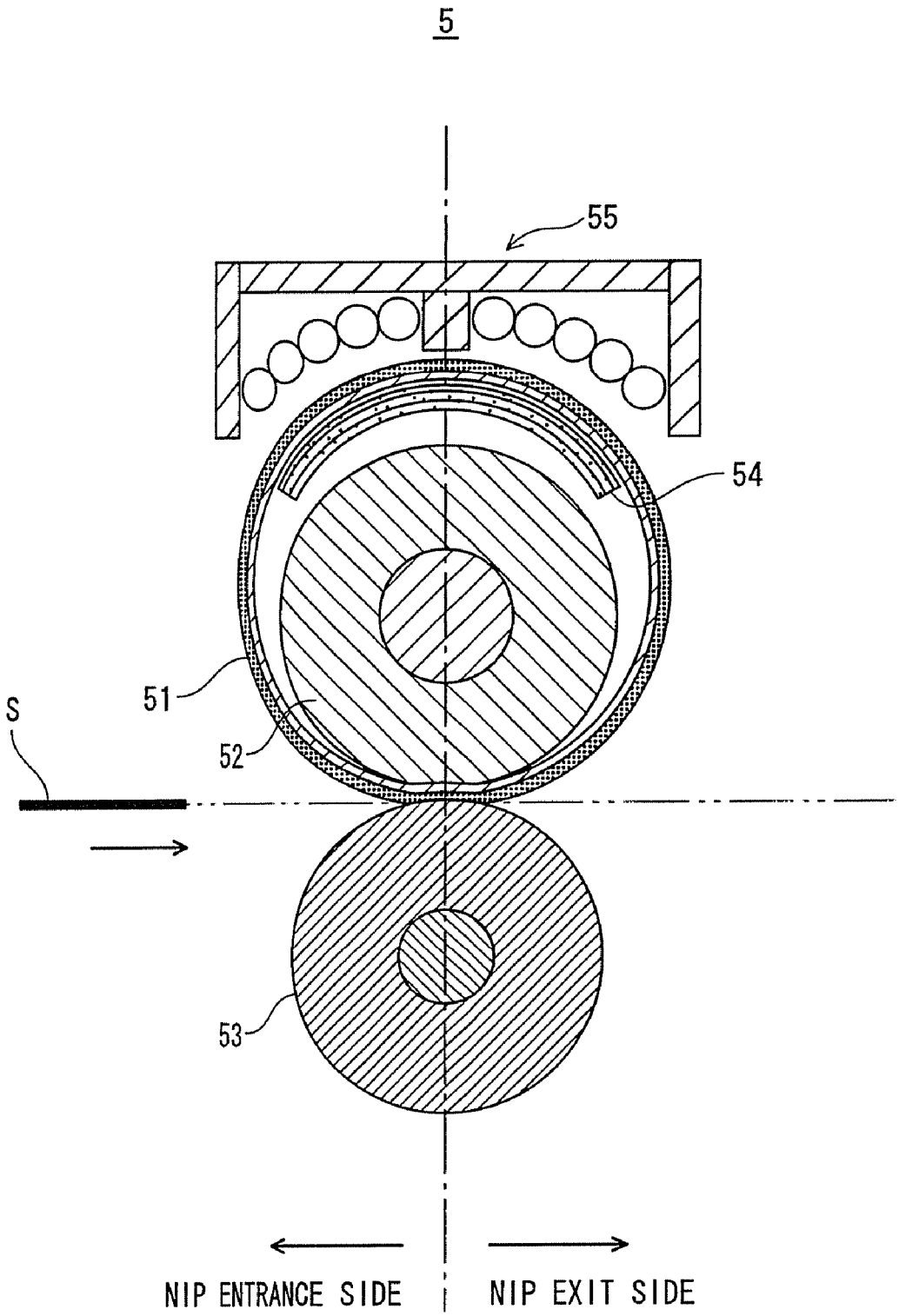
FIG. 2 is a schematic view of a structure of a fixing device.

FIG. 2 schematically shows the structure of the fixing device 5.

As shown in FIG. 2, the fixing device 5 includes a fixing belt 51, a fixing roller 52, a pressure application roller 53, a fixed plate 54, and an excitation coil 55. The fixing belt 51 is a flexible belt that is driven to rotate, and includes a base member made of a resin. In this embodiment, the fixing belt 51 is an endless belt, and includes an elastic layer and a releasing layer layered on the base member. Here, the elastic layer is made of silicone rubber or the like for increasing adhesion between the fixing belt 51 and the recording sheet S during the thermal fixing, thus for improving the fixing performance. The releasing layer is made of a fluororesin or the like for suppressing adhesion between the recording sheet S and the pressure application roller 53. In a cross-sectional plane perpendicular to the rotation axis of the fixing roller 52, the fixing belt 51 has a substantially elliptical shape and satisfies the following relationship: the major axis≦the minor axis×2.

The fixing roller 52 is positioned inside the closed rotation path of the fixing belt 51. The fixing roller 52 includes a columnar core shaft made of steel or aluminum, and an elastic thermal insulation layer made of silicone rubber, silicone sponge or the like layered on an outer circumference of the core shaft.

The pressure application roller 53 presses the fixing roller 52 from the outside of the closed rotation path of the fixing belt 51 such that the fixing nip is formed between the surface of the fixing belt 51 and the pressure application roller 53. The pressure application roller 53 includes a core shaft made of a cylindrical steel, aluminum pipe or the like, an elastic thermal insulation layer made of silicone rubber or the like, and a releasing layer made of a fluorine resin or the like. On an outer circumference of the core shaft, the elastic thermal insulation layer and the releasing layer are layered.

The fixed plate 54 is in contact with the inner circumferential surface of the fixing belt 51 at a position away from the fixing nip and inside the closed rotation path of the fixing belt 51. The fixed plate 54 is positioned substantially opposed to the excitation coil 55 with the fixing belt 51 therebetween. The fixed plate 54 is fixed such that the fixing belt 51 is kept on the closed rotation path because the fixed plate 54 is frictionally in contact with the fixing belt 51 during the rotation of the fixing belt 51. The fixed plate 54 includes at least three layers that are integrally layered in the following stated order, seen from the fixing belt 51: a conductive heat generation layer made of a thin conducting film other than a magnetic shunt alloy; a magnetic shunt alloy layer being made of the magnetic shunt alloy and thicker than the conductive heat generation layer; and a low resistance conductive layer being thicker and having a lower electric resistance value than the conductive heat generation layer and made of a conductive material other than the magnetic shunt alloy. Thus, since the conductive heat generation layer, the magnetic shunt alloy layer and the low resistance conductive layer are integrally layered, the inner circumference of the closed rotation path of the fixing belt 51 can be downsized and accordingly, the fixing belt 51 can be shortened.

The excitation coil 55 faces the outer circumferential surface of the fixing belt 51, and is positioned outside of the closed rotation path of the fixing belt 51 and opposite to the fixed plate 54 with the fixing belt 51 therebetween. The excitation coil 55 generates magnetic flux toward the fixing belt 51 and the fixed plate 54. In this embodiment, by applying an alternating current of approximately 40 kHz supplied from the alternating current generator 2 shown in FIG. 1 to the excitation coil 55, magnetic flux that is reversed at the frequency of the alternating current approximately at 40 kHz is generated.

Described as above, the fixing device 5 of this embodiment has the fixing roller 52 and the fixed plate 54 both surrounded by the inner circumferential surface of the fixing belt 51. Compared with each disclosure of Patent Documents 1 and 2 having two rollers inside the inner circumferential surface of the fixing belt, the fixing belt according to this embodiment is much shorter. Accordingly, the heat capacity of the heat generation member is small, and the fixing device 5 is very advantageous in terms of energy and space saving, reduction of the warm-up period, and so on.

Note that specifics of materials, thickness and the like of each layer are described as follows.

Figure 3:
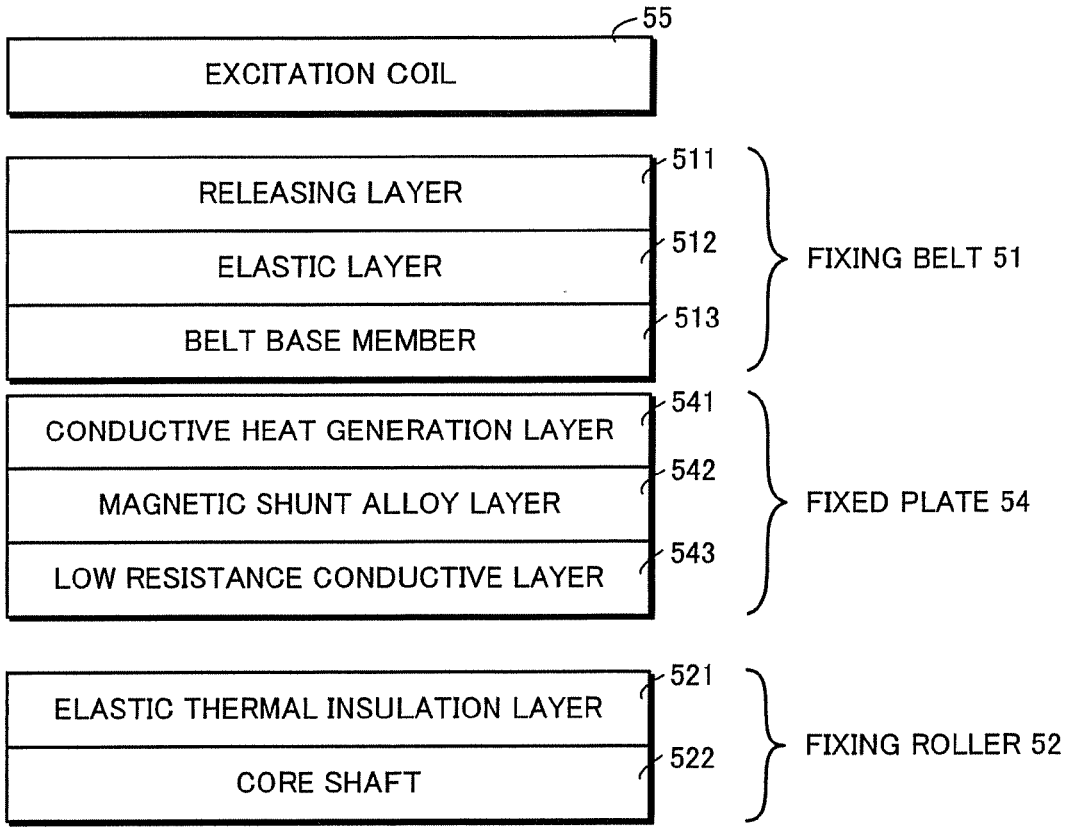
FIG. 3 is a schematic view of a layer structure showing from a center of a fixing roller to an excitation coil.

FIG. 3 is a schematic view of a layer structure showing from the center of the fixing roller 52 to the excitation coil 55.

As shown in FIG. 3, seen from the center of the fixing roller 52, the layer structure is configured as follows. In an outermost portion of the fixing device 5, the excitation coil 55 is positioned. In close proximity to the excitation coil 55, the fixing belt 51 is disposed. The fixing belt 51 has the releasing layer 511, the elastic layer 512, and the belt base member 513 layered therein in the listed order. Furthermore, in close proximity to the fixing belt 51, the fixed plate 54 is disposed. The fixed plate 54 has the conductive heat generation layer 541, the magnetic shunt alloy layer 542, and the low resistance conductive layer 543 layered therein in the listed order. Furthermore, in close proximity to the fixed plate 54, the fixing roller 52 is disposed. The fixing roller 52 has the elastic thermal insulation layer 521 and the core shaft 522. There is a clearance between the excitation coil 55 and the fixing belt 51. The fixing belt 51 is in contact with the fixed plate 54, and there is another clearance between the fixed plate 54 and the fixing roller 52.

According to this embodiment, the material of the releasing layer 511 is PFA. It must be durable at the fixing temperature and have a toner releasing characteristic. The material of the releasing layer 511 is desirably silicone rubber, fluorine rubber, a fluorine resin such as PFA, PTFE, PEP, PFEP or the like.

According to this embodiment, the thickness of the releasing layer 511 is 30 μm. In the light of the durability, energy saving, or the like, the thickness is desirably in a range approximately between 5 μm and 100 μm, inclusive. Practically, the thickness ranging approximately between 5 μm and 50 μm, inclusive, is more desirable.

According to this embodiment, the material of the elastic layer 512 is silicone rubber, and must be thermally resistant and elastic. For example, the material of the elastic layer 512 may be heat-resistant elastomer durable at the fixing temperature, such as silicone rubber, fluorine rubber or the like. In addition, for improvement of the heat conductivity, reinforcement or the like, a filling material may be mixed to the material of the elastic layer 512. In view of the workability, the price and the like, the filling material is desirably silica, alumina, magnesium oxide, boron nitride, beryllium oxide or the like. In addition, diamond, silver, copper, aluminum, marble, glass or the like that has the similar characteristics to the above materials are also applicable.

According to this embodiment, the thickness of the elastic layer 512 is 200 μm. In order to keep the necessary elasticity thereof in the thickness direction, the thickness is desirably 10 μm or more. In addition, when the thickness exceeds 800 μm, it is difficult for heat saved at the belt base member to transmit to the recording sheet S such that heat efficiency is undesirably decreased. Therefore, it is desirable that the thickness ranges approximately between 10 μm and 800 μm, inclusive. Practically, it is more desirable that the thickness ranges between 100 μm and 300 μm, inclusive.

According to this embodiment, the belt base member 513 is an endless PI belt.

According to this embodiment, since the fixed plate generates heat, the fixing belt 51 itself does not need to generate heat. However, in order for the fixing belt 51 to generate heat even a little, particles with high conductivity may be dispersed in the belt base member 513 made of a resin material, or a metal such as Ni (nickel) or the like, may be used for the belt base member 513.

According to this embodiment, the thickness of the belt base member 513 is 40 μm. When the PI belt is used, it is desirable that the thickness ranges approximately between 10 μm and 100 μm, inclusive. Practically, the thickness desirably ranges between 20 μm and 50 μm, inclusive.

According to this embodiment, a material of the conductive heat generation layer 541 is Cu (copper). Note that when the material is made of a low-resistance conductive material, such as Al (aluminum), or Ni (nickel), the conductive heat generation layer 541 is favorably thin so as to increase the resistance value and the heat capacity. Accordingly, the conductive heat generation layer 541 is desirably made with the use of coating method, for example.

According to this embodiment, the thickness of the conductive heat generation layer 541 is 15 μm. When Cu is used as the material, the conductive heat generation layer 541 is desirably made to be thin in order to obtain the necessary heat capacity for the fixing performance. Therefore, it is desirable that the thickness ranges approximately between 5 μm and 30 μm, inclusive. In view of manufacturing stability in the coating method, it is more desirable that the thickness ranges between 10 μm and 20 μm, inclusive.

According to this embodiment, the material of the magnetic shunt alloy layer 542 is a magnetic shunt alloy made of Ni (nickel) and Fe (iron), and a Curie point thereof is 220° C. Note that the material may be a Ni—Fe—Cr (chrome) alloy. The magnetic shunt alloy is ferromagnetic at a temperature lower than the Curie point, and loses its magnetism at a temperature equals to or higher than the Curie point. By adjusting a proportion of each component of the alloy, the Curie point may be arbitrarily set in a given range. The Curie point is desirably set in a range between 180° C. and 240° C., inclusive, and more desirably set approximately at 220° C.

According to this embodiment, the thickness of the magnetic shunt alloy layer 542 is 200 μm. When a Ni—Fe alloy is used as the material, and when the thickness is below 50 μm, the magnetic flux cannot be completely trapped. When the thickness exceeds 400 μm, the heat capacity is increased, which adversely affects the temperature increase characteristics thereof. Thus, it is desirable that the thickness ranges approximately between 50 μm and 400 μm, inclusive. Practically, the magnetic shunt alloy layer having the appropriate thickness is effective so as to keep the rigidity thereof to some extent. Thus, it is more desirable that the thickness ranges between 100 μm and 300 μm, inclusive.

According to this embodiment, the material of the low resistance conductive layer 543 is Cu. Any material will be applicable as long as the material is highly conductive.

According to this embodiment, the thickness of the low resistance conductive layer 543 is 200 μm, and must be thicker and have a much lower impedance value than the conductive heat generation layer 541. When the thickness is below 50 μm, inverse magnetic flux cannot be sufficiently generated. When the thickness exceeds 400 μm, the heat capacity is excessively increased so that the temperature increase characteristics may be adversely affected. Therefore, it is desirable that the thickness ranges approximately between 50 μm and 400 μm, inclusive. Practically, it is more desirable that the thickness ranges between 100 μm and 300 μm, inclusive, which keeps a favorable balance between the quantity of inverse magnetic flux generation and the quantity of heat generation.

Herein, the inverse magnetic flux occurs due to an eddy current produced by the magnetic flux having penetrated through the low resistance conductive layer 543, and is the inverse of the foregoing magnetic flux.

When the temperature of the magnetic shunt alloy layer 542 is lower than the Curie point, the magnetic shunt alloy layer 542 traps the magnetic flux, and the conductive heat generation layer 541 generates heat.

The heat generated at the conductive heat generation layer 541 is transmitted to the fixing belt 51 and is used for the thermal fixing. Also, the heat is transmitted to the magnetic shunt alloy layer 542.

When the magnetic shunt alloy layer 542 is equal to or higher than the Curie point, the magnetic shunt alloy layer 542 having lost the magnetism can no longer trap the magnetic flux. The magnetic flux having penetrated through the magnetic shunt alloy layer 542 arrives at the low resistance conductive layer 543. Since the low resistance conductive layer 543 has a small impedance value, the quantity of heat generation thereof is small when the magnetic flux arrives at the low resistance conductive layer 543. However, because of the generation of an inverse magnetic field, the low resistance conductive layer 543 creates an effect of cancelling out the original magnetic flux. Accordingly, the magnetic flux penetrating through the conductive heat generation layer 541 is decreased, and the quantity of heat generation of the conductive heat generation layer 541 is decreased.

The principle described as above enables the suppression of the temperature increase in the contactless portion occurred when an image is thermally fixed onto a small-sized recording sheet.

According to this embodiment, the material of the elastic thermal insulation layer 521 is a silicone sponge material. The elastic thermal insulation layer 521 thermally insulates and holds the fixing belt 51, and allows flexure of the fixing belt 51 such that a width of the nip is kept. The elastic thermal insulation layer 521 improves performance of ejection and separation of the recording sheet S. In addition, if the elastic thermal insulation layer 521 has two-layer structure including a rubber material and a sponge material, high thermal insulation performance and sufficient elasticity of the elastic thermal insulation layer 521 can be obtained relatively easily.

According to this embodiment, the thickness of the elastic thermal insulation layer 521 is 10 mm. When the material is the silicone sponge material, the thickness desirably ranges between 2 mm and 15 mm, inclusive, and more desirably ranges between 8 mm and 12 mm, inclusive. In addition, the hardness of the elastic thermal insulation layer 521 desirably ranges between 20 and 60 degrees, inclusive, and more desirably ranges between 30 and 50 degrees, inclusive, measured by an Asker rubber hardness tester.

According to this embodiment, the material of the core shaft 522 is aluminum. As long as the strength thereof can be ensured, the material may be a heat-resistant molded pipe, such as steel or PPS (polyphenilene sulfide). However, a nonmagnetic material is desirable such that the core shaft 522 does not generate heat because of leaked magnetic flux.

According to this embodiment, the diameter of the core shaft 522 is 10 mm.

Figure 4:
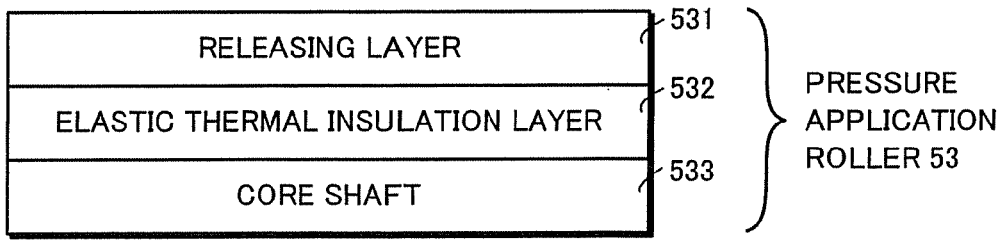
FIG. 4 is a schematic view of a layer structure of a pressure application roller.

FIG. 4 schematically shows a layer structure of the pressure application roller 53.

As shown in FIG. 4, the pressure application roller 53 has a releasing layer 531, an elastic thermal insulation layer 532, and a core shaft 533 layered therein.

According to this embodiment, the material of the releasing layer 531 is a fluorine resin, such as PTFE or PFA. Any material is applicable as long as the material enhances the releasing property of the surface of the releasing layer 531.

According to this embodiment, the thickness of the releasing layer 531 is 20 μm. When a fluorine resin is used therefor, it is desirable that the thickness approximately ranges between 10 μm and 50 μm, inclusive.

The material and the thickness of the elastic thermal insulation layer 532 are similar to those of the elastic thermal insulation layer 521 of the fixing roller 52.

The material and the thickness of the core shaft 533 are similar to those of the core shaft 522 of the fixing roller 52.

<Conclusion>

Described as above, according to the fixing device of Embodiment 1 and the image formation apparatus having the same fixing device, since the conductive heat generation layer, the magnetic shunt alloy layer, the low resistance conductive layer are integrally layered, the components present inside the closed rotation path of the fixing belt can be downsized and the fixing belt can be shortened. Accordingly, the present invention has the self-temperature control function with the use of the magnetic shunt alloy, and reduces the heat capacity of the heat generation member compared with the prior art so that the energy can be saved and the good warm-up property can be achieved.

[Modification 1]

<Overview>

Modification 1 is different from Embodiment 1 only in part of the fixed plate. In the fixed plate according to Modification 1, the low resistance conductive layer is provided in the area of the fixed plate corresponding to the contactless portion with which a smallest-width recording sheet is out of contact when the sheet passes through the fixing nip. However, the low resistance conductive layer is absent in another area of the fixed plate corresponding to the contacting portion with which the smallest-width recording sheet is in contact when the sheet passes through the fixing nip. Thus, the fixing device of Modification 1 has the self-temperature control function and reduces a heat capacity of the heat generation member.

<Structure>

This modification is similar to Embodiment 1 except that the fixed plate 54 is replaced by the fixed plate 56.

Note that components of Modification 1 that are identical with those of Embodiment 1 have the same reference number as Embodiment 1, and explanations there of are omitted.

Figure 5:
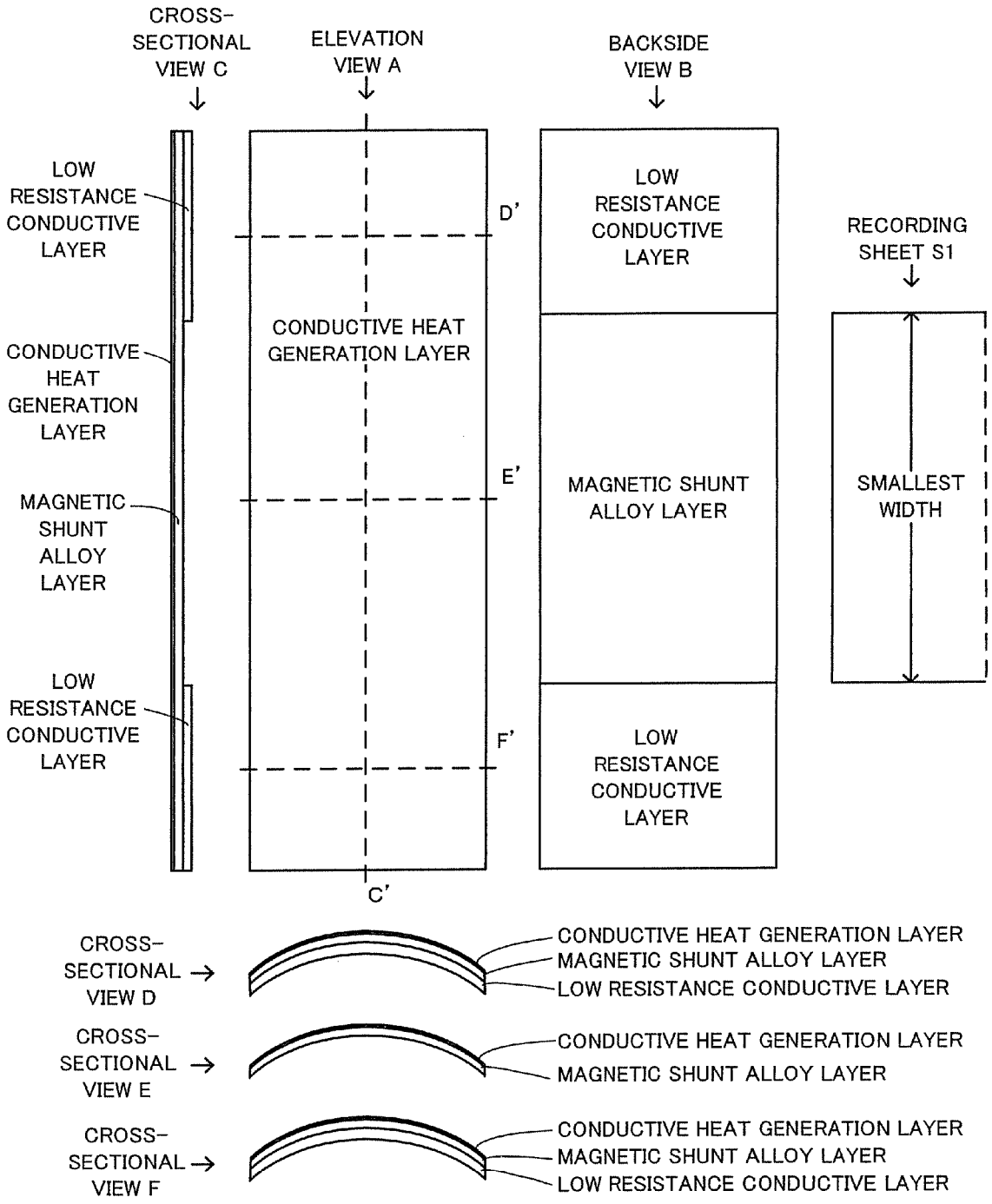
FIG. 5 is a schematic view showing a positional relation between a recording sheet having a smallest width and a fixed plate, and a layer structure of each component of the fixed plate according to Modification 1.

FIG. 5 schematically shows, a smallest-width recording sheet S1 out of serviceable recording sheets S passing through the fixing nip, a positional relationship between the recording sheet S1 and the fixed plate 56 of Modification 1 and a layer structure showing each component of the fixed plate 56.

An elevation view A shown in FIG. 5 is a view of the fixed plate 56 seen from a side the excitation coil. In the elevation view A, everything seen therein is the conductive heat generation layer.

A backside view B shown in FIG. 5 is a view of the fixed plate 56 seen from a side the fixing roller 52. In the center of the area of the fixed plate 56 in a longitudinal direction corresponding to the contacting portion with which the smallest-width recording sheet S1 is in contact when the sheet S1 passes through the fixing nip, the magnetic shunt alloy layer can be directly seen. In each edge of the area of the fixed plate 56 in a longitudinal direction corresponding to the contactless portion with which the smallest-width recording sheet S1 is out of contact when the sheet S1 passes through the fixing nip, the low resistance conductive layer can be directly seen.

A cross-sectional view C shown in FIG. 5 is a view taken longitudinally at the substantially center of the fixed plate 56 (taken along the dashed line C' in the elevation view A). A cross-sectional view E shown in FIG. 5 is a view taken transversely at the substantially center of the fixed plate 56 (taken along the dashed line E' in the elevation view A). Cross-sectional views D and F shown in FIG. 5 are views taken transversely in the area of the fixed plate 56 corresponding to the contactless portion (respectively taken along dashed lines D' and F' in the elevation view A).

As can be seen from each of the cross-sectional views C-F, the fixed plate 56 is structured as follows. In the area of the fixed plate 56 corresponding to the contactless portion, the fixed plate 56 has a layered structure integrating the following three layers. The conductive heat generation layer made of a conductor other than a magnetic shunt alloy, the magnetic shunt alloy layer made of the magnetic shunt alloy and thicker than the conductive heat generation layer, and the low resistance conductive layer thicker than the conductive heat generation layer, and made of a conductor other than the magnetic shunt alloy are integrally layered in the listed order from the fixing belt. In the area of the fixed plate 56 corresponding to the contacting portion (that is to say, the area corresponding to the portion with which recording sheets of all serviceable sizes are in contact when the sheets pass through the fixing nip), two layers that are the conductive heat generation layer and the magnetic shunt alloy layer are integrally layered, but the low resistance conductive layer is absent.

Described as above, according to Modification 1, in addition to similar effects to those of Embodiment 1, since the low resistance conductive layer is not provided in the area corresponding to the contacting portion that is in contact with recording sheets of all serviceable sizes, the heat capacity of the heat generation member can be reduced. Consequently, more energy can be saved and the good warm-up property can be achieved.

[Modification 2]

<Overview>

Modification 2 is different from Embodiment 1 only in part of the fixed plate. According to Modification 2, the fixed plate includes the low friction layer layered on a surface thereof that is frictionally in contact with the fixing belt.

<Structure>

Figure 6:
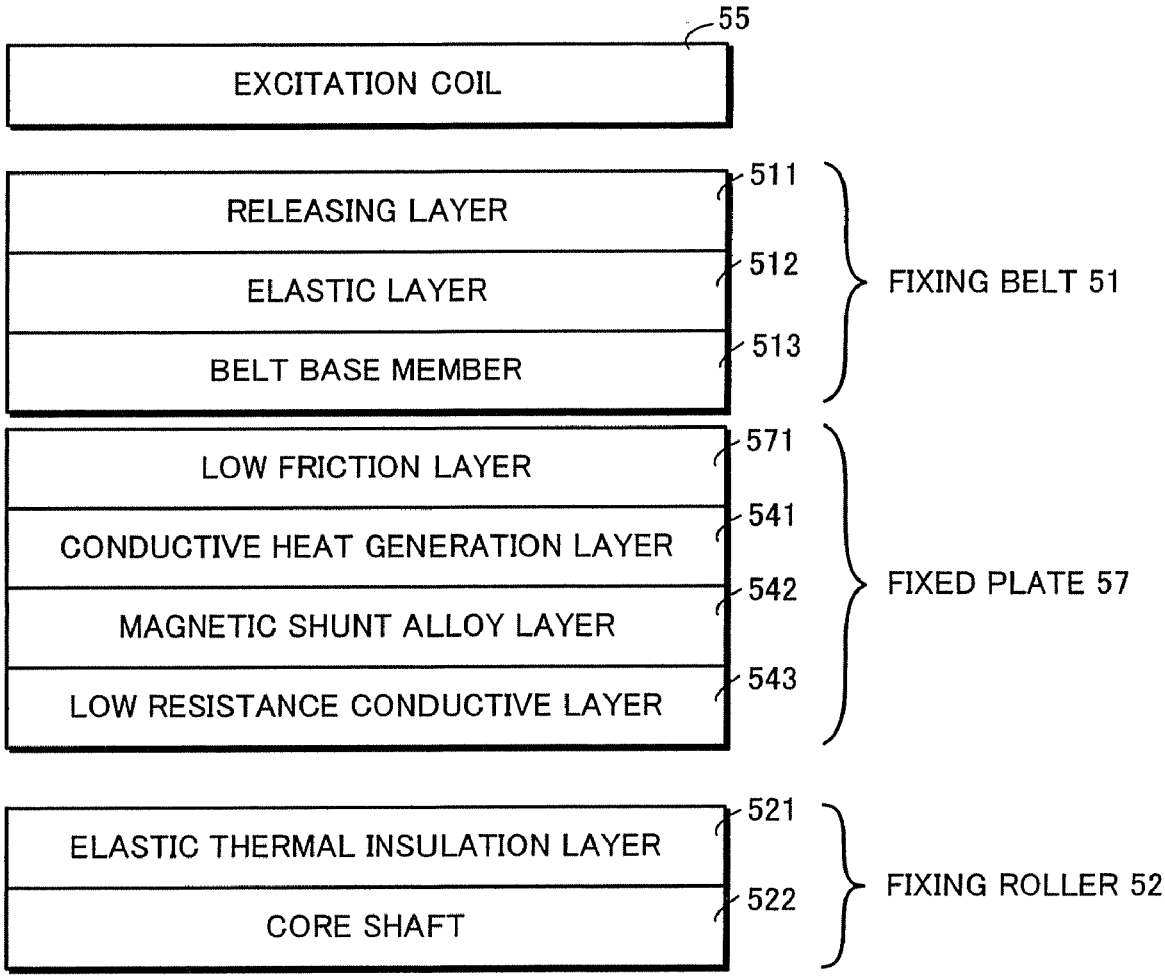
FIG. 6 is a schematic view of a layer structure showing from a center of a fixing roller to an excitation coil according to Modification 2.

FIG. 6 is a schematic view of a layer structure including the fixing roller 52, the fixed plate 57, the fixing belt 51 and the excitation coil 55 according to Modification 2.

Note that, components of Modification 2 that are identical with those of Embodiment 1 have identical reference numbers, and that explanations thereof are omitted.

In the layer structure shown in FIG. 6, the fixed plate 54 in the layer structure shown in FIG. 3 of Embodiment 1 is replaced by the fixed plate 57. Other than that, the layer structure of Modification 2 is similar to that of Embodiment 1.

The fixed plate 57 has the low friction layer 571, the conductive heat generation layer 541, the magnetic shunt alloy layer 542, and the low resistance conductive layer 543 that are layered therein in the listed order seen from the fixing belt 51.

The low friction layer 571 is provided so as to reduce the friction between the fixing belt 51 and the fixed plate 57. The low friction layer 571 must have a lower sliding friction coefficient than the conductive heat generation layer 541 during the rotation of the fixing belt 57. The material thereof is desirably PFA or the like that is thermally resistant. The thickness thereof is 30 μm according to this embodiment. In view of the durability and energy saving, it is desirable that the thickness ranges approximately between 5 μm and 100 μm, inclusive. Practically, the thickness desirably ranges between 5 μm and 50 μm, inclusive.

Described as above, according to Modification 2, in addition to the effects similar to those of Embodiment 1, the following effects can be achieved. Since the fixed plate includes the low friction layer on the surface thereof being frictionally in contact with the fixing belt, driving torque of the fixing belt can be reduced, so that energy can be saved and that the durability can be improved.

[Modification 3]

<Overview>

Modification 3 is different from Embodiment 1 only in part of the fixing belt. According to Modification 3, the fixed plate includes the low friction layer layered on the surface of the fixing belt that is frictionally in contact with the fixed plate.

<Structure>

Figure 7:
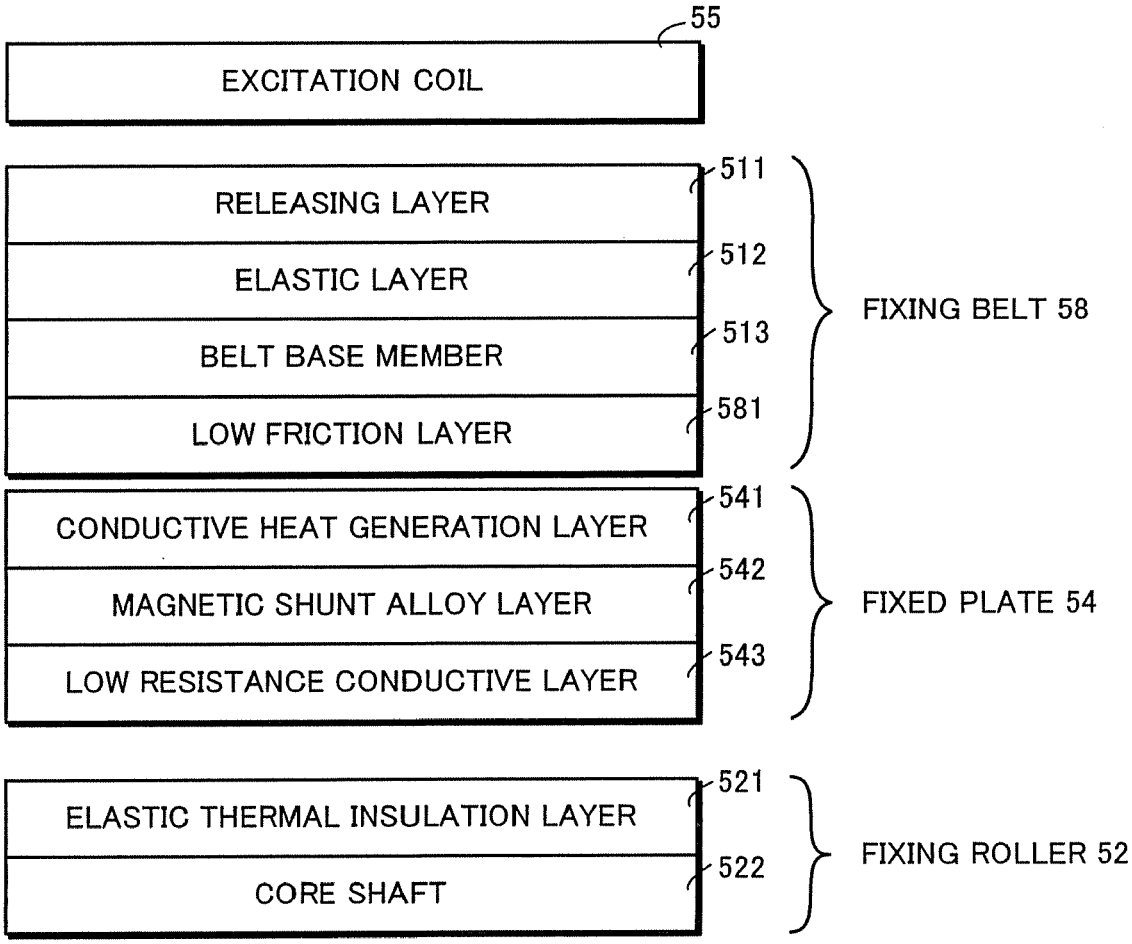
FIG. 7 is a schematic view of a layer structure showing from a center of a fixing roller to an excitation coil according to Modification 3.

FIG. 7 is a schematic view of a layer structure including the fixing roller 52, the fixed plate 54, the fixing belt 58 and the excitation coil 55 according to Modification 3.

Note that, components of Modification 3 that are identical with those of Embodiment 1 have identical reference numbers, and that explanations thereof are omitted.

In the layer structure shown in FIG. 7, the fixing belt 51 in the layer structure shown in FIG. 3 is replaced by the fixing belt 58. Other than that, the layer structure of Modification 3 is similar to that of Embodiment 1.

The fixing belt 58 has the releasing layer 511, the elastic layer 512, the belt base member 513, the low friction layer 581 that are layered therein in the listed order seen from the excitation coil 55.

The low friction layer 581 is provided so as to reduce the sliding friction between the fixing belt 58 and the fixed plate 54. The fixing belt 58 must have a lower sliding friction coefficient than the belt base member 513 during the rotation of the fixing belt 58. The material of the low friction layer 581 is desirably PFA or the like that is thermally resistant, for example. The thickness thereof is 30 μm, according to this embodiment. In view of the durability, energy saving and the like, it is desirable that the thickness ranges approximately between 5 μm and 100 μm, inclusive. Practically, it is more desirable that the thickness ranges between 5 μm and 50 μm, inclusive.

Described as above, according to Modification 3, in addition to the effects similar to those of Embodiment 1, the following effects can be achieved. Since the fixing belt includes the low friction layer on the surface thereof being frictionally in contact with the fixing plate, the driving torque of the fixing belt is reduced, and energy can be saved and the durability can be improved, similarly to Modification 2.

[Modification 4]

<Overview>

Modification 4 is different from Embodiment 1 only in part of the fixed plate and in part of the fixing belt. According to Modification 4, the fixed plate includes the low friction layer on the surface thereof being frictionally in contact with the fixing belt. In addition, the fixing belt also includes the low friction layer on the surface thereof being frictionally in contact with the fixed plate.

<Structure>

Figure 8:
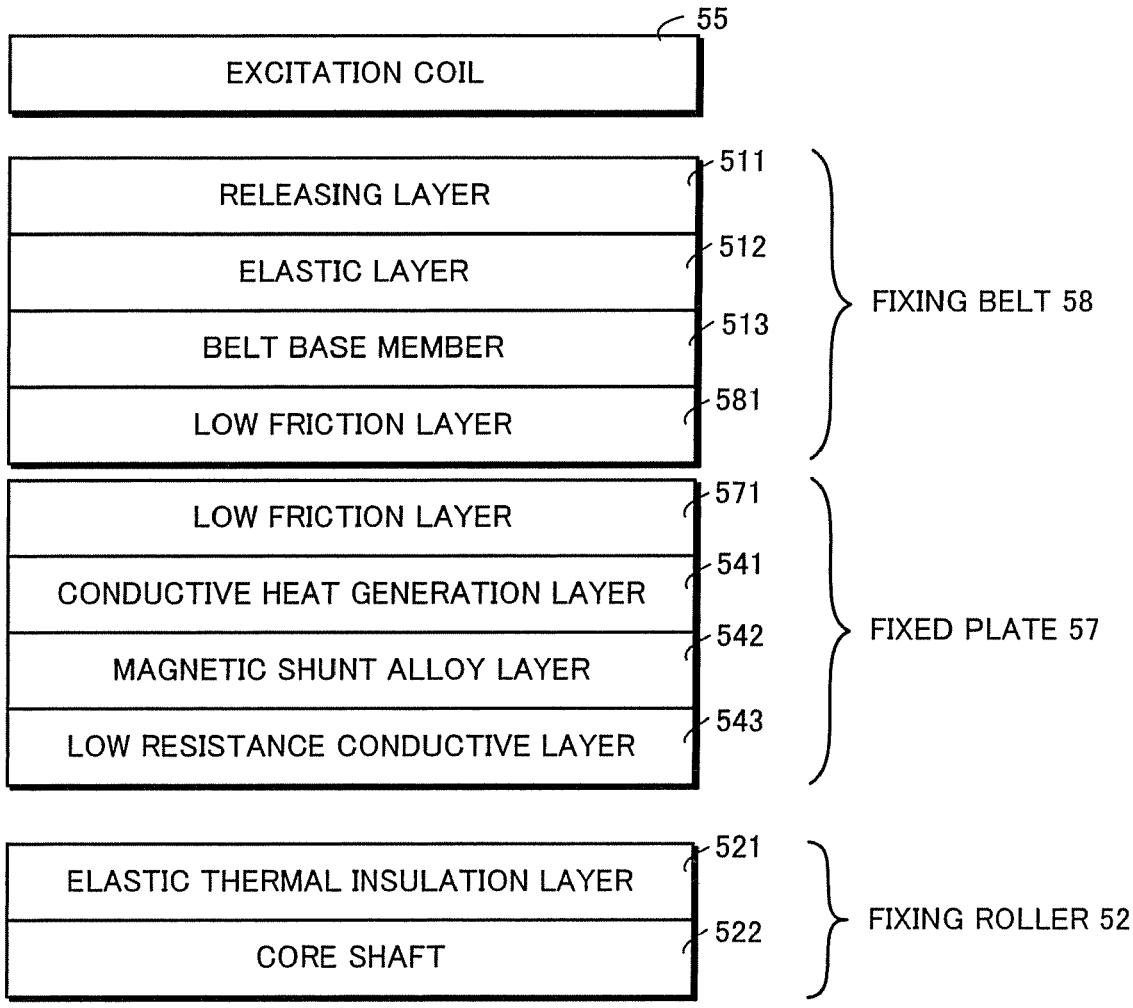
FIG. 8 is a schematic view of a layer structure showing from a center of a fixing roller to an excitation coil according to Modification 4.

FIG. 8 is a schematic view of a layer structure including the fixing roller 52, the fixed plate 57, the fixing belt 58 and the excitation coil 55 according to Modification 4.

Note that, components of Modification 4 that are identical with those of Embodiment 1, and Modifications 2 and 3 have identical reference numbers, and that explanations thereof are omitted.

In the layer structure shown in FIG. 8, the fixed plate 54 in the layer structure shown in FIG. 3 is replaced by the fixed plate 57, and the fixing belt 51 in the layer structure shown in FIG. 3 is replaced by the fixing belt 58. Other than that, the layer structure of Modification 4 is similar to that of Embodiment 1.

Described as above, according to Modification 4, in addition to the effects similar to those of Embodiment 1, the following effects can be achieved. Since the fixed plate includes the low friction layer on the surface thereof that is frictionally in contact with the fixing belt, and the fixing belt also includes the low friction layer on the surface thereof that is frictionally in contact with the fixed plate, driving torque of the fixing belt can be reduced so that energy can be saved and the durability can be improved, similarly to Modifications 2 and 3.

Note that any of Modifications 2-4 may be applied to Modification 1. For example, when Modification 2 is applied to Modification 1, in the area of the fixed plate 59 (unshown) corresponding to the contactless portion, the low friction layer 571, the conductive heat generation layer 541, the magnetic shunt alloy layer 542, and the low resistance conductive layer 543 are layered in the listed order seen from the fixing belt 51. On the other hand, in the area of the fixed plate 59 corresponding to the contacting portion, the low resistance conductive layer is absent, and two layers that are the conductive heat generation layer 541 and the magnetic shunt alloy layer 542 are integrally layered.

Furthermore, when Modification 3 is applied to Modification 1, this fixed plate is equivalent to the fixed plate 56 of Modification 1, and this fixing belt is equivalent to the fixing belt 58 of Modification 3.

Furthermore, when Modification 4 is applied to Modification 1, this fixed plate is equivalent to the fixed plate 59, and this fixing belt is equivalent to the fixing belt 58 of Modification 3.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A fixing device that thermally fixes an unfixed image onto a recording sheet having the unfixed image formed thereon, by passing the recording sheet through a fixing nip, the fixing device comprising:

an endless belt being rotated in a closed rotation path and being heated by electromagnetic induction;

a first roller being positioned inside the closed rotation path;

a second roller pressing the first roller from outside of the closed rotation path such that the fixing nip is formed between an outer circumferential surface of the belt and the second roller;

an excitation coil being positioned outside the closed rotation path; and a fixed plate being positioned inside the closed rotation path, being in contact with an inner circumferential surface of the belt, and being substantially opposed to the excitation coil with the belt therebetween, the fixed plate keeping the belt on the closed rotation path, wherein the fixed plate includes:

a magnetic shunt alloy layer made of a magnetic shunt alloy;

a conductive heat generation layer being disposed toward a main surface of the magnetic shunt alloy layer facing the belt, being made of a conductor other than the magnetic shunt alloy, and being thinner than the magnetic shunt alloy layer; and a low resistance conductive layer being disposed toward another main surface of the magnetic shunt alloy layer, having a lower electric resistance value than the conductive heat generation layer, and being thicker than the conductive heat generation layer.

2. The fixing device of claim 1, wherein a thickness of the magnetic shunt alloy layer ranges between 100 μm and 300 μm, inclusive, a thickness of the conductive heat generation layer ranges between 10 μm and 30 μm, inclusive, and a thickness of the low resistance conductive layer ranges between 100 μm and 300 μm, inclusive.

3. The fixing device of claim 1, wherein in an area of the fixed plate corresponding to a contactless portion with which a recording sheet of a serviceable smallest width is out of contact when the sheet passes through the fixing nip, the conductive heat generation layer, the magnetic shunt alloy layer, and the low resistance conductive layer are layered, and in another area of the fixed plate corresponding to a contacting portion with which the recording sheet of the serviceable smallest width is in contact when the sheet passes through the fixing nip, the magnetic shunt alloy layer and the low resistance conductive layer are layered, the conductive heat generation layer being excluded.

4. The fixing device of claim 1, wherein the magnetic shunt alloy layer is made of a Ni—Fe alloy or a Ni—Fe—Cr alloy, and a Curie point of the magnetic shunt alloy layer ranges between 180° C. and 240° C., inclusive.

5. The fixing device of claim 1, wherein the fixed plate further includes a low friction layer being disposed closest to the belt, the low friction layer having a lower sliding friction coefficient than the conductive heat generation layer during the rotation of the belt, and during the rotation of the belt, the inner circumferential surface of the belt slides with low friction on the low friction layer.

6. The fixing device of claim 1, wherein the belt includes a low friction layer being disposed on the inner circumferential surface of the belt, the low friction layer having a lower sliding friction coefficient than a base member of the belt during the rotation of the belt, and during the rotation, the fixed plate slides with low friction on the low friction layer.

7. The fixing device of claim 1, wherein the fixed plate includes a first low friction layer being disposed closest to the belt, the first low friction layer having a lower sliding friction coefficient than the conductive heat generation layer during the rotation of the belt, the belt includes a second low friction layer being disposed on the inner circumferential surface of the belt, the second low friction layer having a lower sliding friction coefficient than a base member of the belt during the rotation of the belt, and during the rotation of the belt, the first low friction layer slides with low friction on the second low friction layer.

8. The fixing device of claim 1, wherein the low friction layer is made of a fluororesin.

9. The fixing device of claim 1, wherein in a cross-sectional plane perpendicular to a rotation axis of the first roller, the belt has a substantially elliptical shape, and a major axis and a minor axis of the elliptical shape satisfy the following relationship:

the major axis≦the minor axis×2.

10. An image formation apparatus including a fixing device as in claim 1.

* * * * *